United States Patent [19]

Perez et al.

[11] 4,266,524

[45] May 12, 1981

[54] DEVICE FOR REGULATING THE AMOUNT OF EXHAUST GASES RECYCLED TO A DIESEL ENGINE

[75] Inventors: Jean Pérez, Rueil Malmaison; Jean-Claude Carnus, Paris, both of France

[73] Assignees: Automobiles Peugeot; Societe Anonyme Automobiles Citroen, both of Paris, France

[21] Appl. No.: 83,601

[22] Filed: Oct. 11, 1979

[30] Foreign Application Priority Data

Nov. 24, 1978 [FR] France ..... 78 33196

[51] Int. Cl.[3] ..... F02B 33/00

[52] U.S. Cl. ..... 123/568

[58] Field of Search ..... 123/119 A, 568, 569, 123/570

[56] References Cited

U.S. PATENT DOCUMENTS

| | | | |
|---|---|---|---|
| 3,970,061 | 7/1976 | Caldwell | 123/568 |
| 4,130,098 | 12/1978 | Linder | 123/568 |
| 4,171,689 | 10/1979 | Eheim | 123/568 |
| 4,202,524 | 5/1980 | Brakebill | 123/568 |

*Primary Examiner*—Ronald B. Cox

*Attorney, Agent, or Firm*—Burns, Doane, Swecker & Mathis

[57] ABSTRACT

The device comprises a connecting pipe which interconnects the exhaust pipe and the induction pipe of the engine. Valve means are inserted in the connecting pipe and the portion of the connecting pipe between the valve means and the exhaust pipe and the portion between the induction pipe and the valve means are short and of large section. The section of the passage through the valve means, defined by a cylinder formed in a seat, is small relative to the section of the connecting pipe and the valve member which cooperates with the seat has a cylindrical end portion whose diameter is slightly less than the diameter of the cylinder and whose length is slightly greater than the length of the seat.

4 Claims, 2 Drawing Figures

1
2
3
4
5
6
7
8
9
10
11
12
13
14
15
16

6
8
17
18

DEVICE FOR REGULATING THE AMOUNT OF EXHAUST GASES RECYCLED TO A DIESEL ENGINE

DESCRIPTION

The present invention relates to a device employed for regulating for an internal combustion engine the amount of exhaust gases which is reintroduced into the induction pipe so as to reduce the expulsion of harmful gases to the atmosphere. It is more particularly applicable to Diesel engines.

In Diesel-type engines, it has been found that there is a considerable soiling of the connection passages between the exhaust pipe and the induction pipe, and in particular of the valve which controls the flow of gases which are recycled in accordance with the conditions of use of the engine. There is consequently a progressive reduction in the section of passage through the valve which results in a difference between the amount of gas effectively recycled and the theoretical amount which produces the best results.

Now, it has been found that the amount of the deposits is considerably reduced at high temperature.

An object of the invention is to provide a special arrangement of the connection between the exhaust and induction pipes and the valve means, this arrangement being subject to soiling as little as possible.

According to the invention, there is provided a device for regulating the amount of exhaust gases recycled to an internal combustion engine, comprising a pipe interconnecting the exhaust pipe and the induction pipe and valve means mounted in said connecting pipe, wherein the portions of the connecting pipe located between the valve means and the exhaust pipe on one hand, and the induction pipe and the valve means on the other hand, are short and of large section, the section of the passage through the valve means, constituted by a cylinder formed in a seat, is reduced relative to the section of said connecting pipe, and a valve member cooperating with the seat comprises a cylindrical end portion which has a diameter very slightly less than the diameter of, and a length greater than the length of, the cylinder of the seat.

According to a particular feature of the invention, the portion of the connecting pipe located between the valve means and the induction pipe comprises a bellows for compensating for deformations due to the large differences of temperature.

Figure 1:
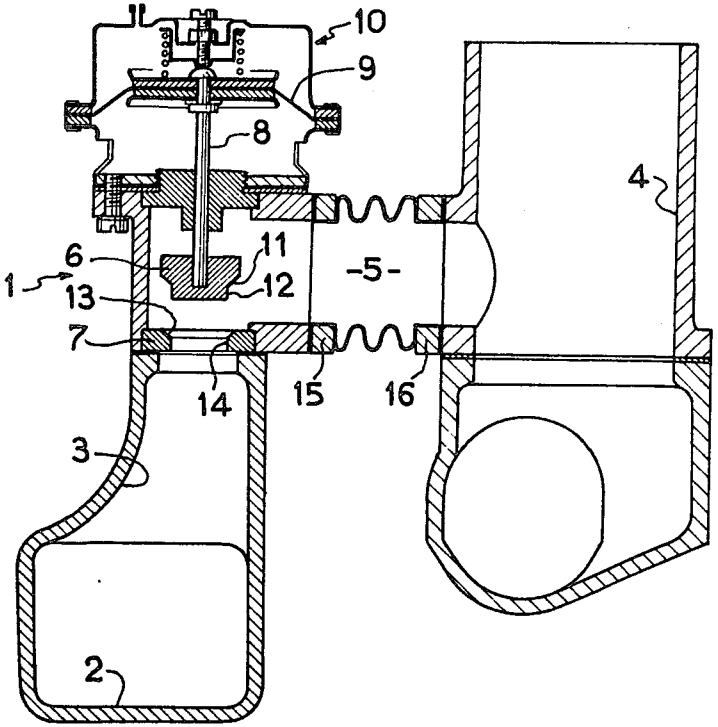
Figure 2:
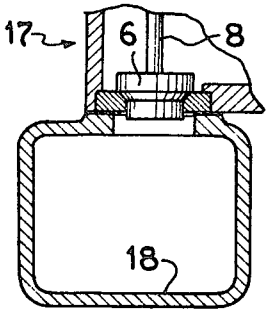

An embodiment is described in the ensuing description with reference to the accompanying drawing in which:

FIG. 1 is a sectional view of the connection between the exhaust and the induction pipes of a regulating device according to the invention, the valve means of which is in its open position, and FIG. 2 is a partial view of a modification of the regulating device of FIG. 1, the valve means of which is in the closing position.

In FIG. 1, a valve means 1 is connected to an exhaust pipe 2 by a pipe 3 and to an induction pipe 4 by a pipe 5.

The valve means 1 comprises a valve member 6 which cooperates with a seat 7. The valve member 6 is connected by a rod 8 to a diaphragm 9 of a suction box 10 which is supplied with a vacuum in accordance with the conditions of operation of the engine in the known manner.

The valve member 6 comprises a part-conical portion 11 and a cylindrical portion 12. The part-conical portion 11 ensures the complete closure of the valve means by application thereof against a corresponding part-conical portion 13 of the seat 7. The latter also has a cylindrical portion 14 which defines an aperture which determines the flow of gases recycled through the passage comprising the pipe 3, the aperture defined by the portion 14 and the pipe 5, when the valve means is open. This cylindrical portion 14 has a diameter very slightly greater than the diameter of, and a length less than the length of, the cylindrical part 12 of the valve member so that the movements of the valve member effect a self-cleaning of the passage through the valve means since they gradually remove the deposits which may be produced thereon.

The pipe 3 is relatively short and has a large section, in particular relative to the section of the aperture through the cylindrical portion 14 of the seat 7. In this way, the assembly is strongly heated by the exhaust gases coming from the pipe 2 and the volume of the deposits is considerably reduced.

The pipe 5 is formed by a bellows which comprises in the known manner a metal wall having parallel corrugations. This bellows is fixed by flanges 15 and 16 respectively to the valve means 1 and the induction pipe 4. Although this pipe is short in length, its shape permits the absorption of the relative displacement mainly due to variations in temperature between the valve means 1 and the induction pipe 4.

The device shown in FIG. 2 differs from the device of FIG. 1 only in that the valve means 17 is mounted directly on the exhaust pipe 18 and communicates with the interior of the latter through an aperture formed in the wall of the exhaust pipe.

The valve means may also be mounted on a simple local deformation of the exhaust pipe.

Owing to the arrangement just described, the regulation of the amount of gases recycled can be held well constant with respect to time so that the expulsion of the polluting gases to the atmosphere can be maintained at a very low level.

Having now described our invention what we claim as new and desire to secure by Letters Patent is:

1. In a device for regulating the amount of exhaust gases recycled to an internal combustion engine having an exhaust pipe and an induction pipe, comprising means defining a passage interconnecting the exhaust pipe and the induction pipe, and valve means inserted in said passage, said valve means comprising a valve body, a seat defining within the valve body an aperture for the exhaust gases and a valve member within the valve body and cooperative with the seat for regulating the flow of the exhaust gases through the aperture; the improvement comprising in combination the feature that a first part of said passage extending from the valve means to the exhaust pipe is larger in section than said aperture and a second part of said passage extending from the valve means to the induction pipe is larger in section than said aperture, and the feature that a part of said passage extending from the valve body to the induction pipe comprises a bellows, whereby said passage and said valve means are heated by the exhaust gases and consequential deformations due to large differences in temperature between the valve means and the induction pipe are accomodated by said bellows.

2. A device as claimed in claim 1, wherein said first part of the passage has a length which is at the most substantially equivalent to a maximum transverse extent of said first part of the passage.

3. A device as claimed in claim 1, wherein the valve means is mounted directly on the exhaust pipe which is defined by a wall and said first part of the passage is defined by an aperture in said wall of the exhaust pipe.

4. A device as claimed in claim 1, wherein said second part of the passage has a length which is at the most substantially twice the transverse extent of said second part of the passage.

* * * * *